US008322555B2

(12) United States Patent
Chen

(10) Patent No.: US 8,322,555 B2
(45) Date of Patent: Dec. 4, 2012

(54) RESEALABLE TAMPER-EVIDENT CONTAINER ASSEMBLY AND LID

(75) Inventor: Allan K. Chen, New York City, NY (US)

(73) Assignee: PWP Industries, Inc., Lake Forest, IL (US)

( * ) Notice: Subject to any disclaimer, the term of this patent is extended or adjusted under 35 U.S.C. 154(b) by 1029 days.

(21) Appl. No.: 12/251,144

(22) Filed: Oct. 14, 2008

(65) Prior Publication Data

US 2010/0089922 A1 Apr. 15, 2010

Related U.S. Application Data

(63) Continuation-in-part of application No. 29/307,796, filed on May 13, 2008, now Pat. No. Des. 583,238.

(51) Int. Cl.

| | |
|---|---|
| ***B65D 41/32*** | (2006.01) |
| ***B65D 41/18*** | (2006.01) |
| *B65D 90/02* | (2006.01) |
| *B65D 21/00* | (2006.01) |

(52) U.S. Cl. ..... 220/266; 220/270; 220/669; 220/675; 220/780; 215/254; 206/515

(58) Field of Classification Search ..... 220/266, 220/270, 380, 780, 871, 790, 791, 268, 669, 220/675; 206/515; 215/254

See application file for complete search history.

(56) References Cited

U.S. PATENT DOCUMENTS

| | | | | |
|---|---|---|---|---|
| 2,701,053 A | | 2/1955 | Tamarin | |
| 3,266,965 A | | 8/1966 | Spees | |
| 3,753,511 A | * | 8/1973 | Ruch | 215/256 |
| 3,826,420 A | | 7/1974 | Bamburg et al. | |
| 3,836,039 A | | 9/1974 | Seiferth et al. | |
| D246,955 S | | 1/1978 | Davis | |
| 4,098,577 A | | 7/1978 | Halpern | |
| D251,828 S | | 5/1979 | Smith | |
| 4,281,774 A | * | 8/1981 | Mumford | 220/270 |
| 4,424,911 A | | 1/1984 | Resnick | |
| 4,436,203 A | | 3/1984 | Reyner | |

(Continued)

FOREIGN PATENT DOCUMENTS

| | | |
|---|---|---|
| EP | 1 559 656 | 8/2005 |

(Continued)

OTHER PUBLICATIONS

Product Catalog, "Crystal Clear Packaging & Packaging Automation Solution", Inline Plastics Corp. undated.

*Primary Examiner* — Robin Hylton
(74) *Attorney, Agent, or Firm* — Nixon Peabody LLP

(57) ABSTRACT

A lid includes a generally flat interior portion and an outer ridge area surrounding the interior portion. The outer ridge area includes a first ridge side, a ridge top, and a second ridge side. The first ridge side extends generally upward from the interior portion. The ridge top extends from the first ridge side and is generally parallel to the interior portion. The second ridge side extends generally downward from the ridge top. The second ridge side includes a top section and a bottom section. A thickness of the bottom section is smaller than a thickness of the top section. The bottom section includes at least one fixed tab and at least one tear band. The at least one fixed tab is separated from the at least one tear band by at least one vertical membrane.

17 Claims, 4 Drawing Sheets

U.S. PATENT DOCUMENTS

| | | | | | |
|---|---|---|---|---|---|
| 4,449,632 | A | | 5/1984 | Marusiak, Jr. | |
| 4,475,661 | A | | 10/1984 | Griffin | |
| 4,479,588 | A | | 10/1984 | Davis et al. | |
| 4,489,841 | A | | 12/1984 | Thompson | |
| 4,503,123 | A | | 3/1985 | Ou-Yang | |
| 4,546,881 | A | | 10/1985 | Tasma | |
| 4,555,056 | A | | 11/1985 | Bernhardt | |
| 4,558,785 | A | | 12/1985 | Gordon | |
| 4,610,371 | A | | 9/1986 | Karkiewicz | |
| D286,026 | S | | 10/1986 | Rayner | |
| 4,645,078 | A | | 2/1987 | Reyner | |
| 4,660,732 | A | | 4/1987 | Moore | |
| 4,685,578 | A | | 8/1987 | Dunshee | |
| D292,380 | S | | 10/1987 | Smith | |
| 4,757,898 | A | | 7/1988 | Klein | |
| 4,773,541 | A | | 9/1988 | Riddell | |
| 4,778,059 | A | | 10/1988 | Martin et al. | |
| 4,813,541 | A | | 3/1989 | Velasco et al. | |
| 4,813,564 | A | | 3/1989 | Cooper et al. | |
| 4,877,143 | A | | 10/1989 | Travisano | |
| 4,881,656 | A | | 11/1989 | Chumley et al. | |
| 4,890,763 | A | | 1/1990 | Curiel | |
| 4,930,656 | A | * | 6/1990 | Blanchette | 220/276 |
| 4,945,708 | A | | 8/1990 | Curiel | |
| 4,946,723 | A | | 8/1990 | Paules et al. | |
| 4,966,294 | A | | 10/1990 | Mack et al. | |
| 4,966,470 | A | | 10/1990 | Thompson et al. | |
| 5,040,695 | A | | 8/1991 | Adams et al. | |
| 5,042,653 | A | | 8/1991 | Ems | |
| 5,042,680 | A | * | 8/1991 | Argudo et al. | 220/276 |
| 5,064,664 | A | | 11/1991 | Hustad | |
| 5,103,979 | A | | 4/1992 | Hustad | |
| 5,111,953 | A | | 5/1992 | Faust et al. | |
| 5,137,208 | A | | 8/1992 | Wang et al. | |
| D338,621 | S | | 8/1993 | Balson | |
| 5,238,135 | A | * | 8/1993 | Landis | 220/276 |
| 5,249,694 | A | | 10/1993 | Nelson | |
| 5,373,955 | A | * | 12/1994 | Marino | 215/256 |
| D369,107 | S | | 4/1996 | Landis | |
| 5,507,406 | A | | 4/1996 | Urciuoli et al. | |
| 5,540,349 | A | | 7/1996 | Philips | |
| 5,797,510 | A | | 8/1998 | Carrier et al. | |
| 5,836,697 | A | | 11/1998 | Chiesa | |
| 5,897,011 | A | | 4/1999 | Brilliant et al. | |
| 5,979,690 | A | | 11/1999 | Hartley | |
| 6,056,141 | A | | 5/2000 | Navarini et al. | |
| 6,276,529 | B1 | | 8/2001 | Feehan, Jr. | |
| 6,349,828 | B1 | | 2/2002 | Sessions et al. | |
| D469,693 | S | | 2/2003 | Weiss et al. | |
| 6,572,909 | B1 | | 6/2003 | Bagwell et al. | |
| 6,588,653 | B1 | | 7/2003 | Schmidt | |
| D517,322 | S | | 3/2006 | Zettle et al. | |
| 7,055,692 | B2 | | 6/2006 | Waga et al. | |
| 7,073,680 | B2 | | 7/2006 | Boback et al. | |
| 7,118,003 | B2 | | 10/2006 | Sellari et al. | |
| D545,618 | S | | 7/2007 | Zettle et al. | |
| D574,238 | S | | 8/2008 | Walker et al. | |
| 2004/0026423 | A1 | | 2/2004 | Cappel et al. | |
| 2004/0035718 | A1 | | 2/2004 | Waga et al. | |
| 2004/0118848 | A1 | | 6/2004 | Marshall | |
| 2004/0150221 | A1 | | 8/2004 | Brown | |
| 2005/0017007 | A1 | | 1/2005 | Sellari et al. | |
| 2005/0161455 | A1 | | 7/2005 | Studee | |
| 2005/0173435 | A1 | | 8/2005 | Wellman et al. | |
| 2005/0184070 | A1 | | 8/2005 | Boback et al. | |
| 2006/0006178 | A1 | | 1/2006 | Foldesi, Sr. et al. | |
| 2006/0011632 | A1 | | 1/2006 | Caille | |
| 2006/0163265 | A1 | | 7/2006 | De Candido | |
| 2006/0278652 | A1 | | 12/2006 | Vovan et al. | |
| 2006/0289549 | A1 | | 12/2006 | Vovan | |
| 2007/0045317 | A1 | | 3/2007 | Rosender et al. | |
| 2007/0138180 | A1 | | 6/2007 | Vovan | |
| 2008/0000904 | A1 | | 1/2008 | Vovan | |
| 2008/0006632 | A1 | | 1/2008 | Vovan | |

FOREIGN PATENT DOCUMENTS

| | | |
|---|---|---|
| EP | 1 736 417 | 12/2006 |
| WO | WO 2005/082733 | 9/2005 |
| WO | WO 2005/082734 | 9/2005 |

* cited by examiner

RESEALABLE TAMPER-EVIDENT CONTAINER ASSEMBLY AND LID

CROSS-REFERENCE TO RELATED APPLICATION

This application is a continuation-in-part of U.S. Design Patent Application No. 29/307796, filed May 13, 2008,now U.S. Pat. No. Des. 583,238 which is hereby incorporated by reference in its entirety.

FIELD OF THE INVENTION

The present invention relates generally to a storage container assembly including a container and a lid. More specifically, the present invention relates to a tamper-evident container and lid assembly providing evidence when one has removed or attempted to remove the lid from the container.

BACKGROUND OF THE INVENTION

Sealable storage containers are often used to store items such as food, medicine, and the like. Such items are potentially dangerous to consumers if they have been contaminated before reaching the consumer. It is often difficult to determine whether the container has been previously tampered with or opened merely by examining the items themselves because many items do not provide an observable indication that have been tampered with or contaminated.

Thus, many producers of such items package their items in such a way that a consumer may readily examine a container and determine whether the contents of the container may have been tampered with after the item was packaged within the container. Such packaging often involves a seal or other indicia, either associated with the lid, the container, or both, that is broken or otherwise altered when the container is initially opened so that the seal or indicia cannot be replaced or repaired in the same condition. Thus, a seal or indicia in a condition different from its initial condition indicates to a consumer that the contents of the container should not be used because they may have been contaminated.

Many existing lids having tamper-evident features have several disadvantages. For example, existing tamper-evident lids are often not resealable. Thus, once the tamper-evident feature has been broken, the lid does not reseal to a container. Rather, the lid has a loose fit atop the container and often falls off when the container is moved or even slightly inverted. Other existing tamper-evident lids include multiple tamper-evident features (e.g., vertical membranes, perforations, or the like), thereby making the lid more susceptible to accidental breakage of the tamper-evident feature.

It would be desirable to provide a container assembly that addresses these disadvantages and provides tamper-evidence to a consumer.

SUMMARY OF THE INVENTION

According to one embodiment of the present invention a lid comprises a generally flat interior portion and an outer ridge area surrounding the interior portion. The outer ridge area includes a first ridge side, a ridge top, and a second ridge side. The first ridge side extends generally upward from the interior portion. The ridge top extends from the first ridge side and is generally parallel to the interior portion. The second ridge side extends generally downward from the ridge top. The second ridge side includes a top section and a bottom section. A thickness of the bottom section is smaller than a thickness of the top section. The bottom section includes at least one fixed tab and at least one tear band. The at least one fixed tab is separated from the at least one tear band by at least one vertical membrane.

According to another embodiment, a container assembly comprises a container including a bottom, at least one sidewall integrated with and extending from the bottom, and a lip portion extending outwardly from a portion of the at least one sidewall positioned generally opposite the bottom. The container assembly further comprises a lid including a generally flat interior portion and an outer ridge area surrounding the interior portion. The outer ridge area includes a first ridge side, a ridge top, and a second ridge side. The first ridge side extends generally upward from the interior portion. The ridge top extends from the first ridge side and is generally parallel to the interior portion. The second ridge side extends generally downward from the ridge top. The second ridge side includes a protrusion on an inner surface, a top section, and a bottom section. A thickness of the bottom section is smaller than a thickness of the top section. The bottom section includes at least one fixed tab and at least one tear band. The at least one fixed tab is separated from the at least one tear band by at least one vertical membrane. The protrusion on the inner surface of the second ridge side forms a seal with the lip portion of the container when the container assembly is in a closed position.

According to yet another embodiment, a tamper-evident lid comprises a generally flat disc portion and an outer ridge area surrounding the disc portion. The outer ridge area includes a first ridge side extending generally upward from the disc portion, a ridge top extending from the first ridge side and being generally parallel to the disc portion, and a second ridge side extending generally downward from the ridge top. The second ridge side includes a top section and a bottom section. A thickness of the bottom section is smaller than a thickness of the top section. The top section is separated from the bottom section by a thinned-out area. The top section includes at least one protrusion. The bottom section includes at least one fixed tab and at least one tear band. The at least one fixed tab is separated from the at least one tear band by at least one vertical membrane. A thickness of the vertical membrane is smaller than the thickness of the bottom section. The lid is formed from linear low density polyethylene.

The above summary of the present invention is not intended to represent each embodiment or every aspect of the present invention. Additional features and benefits of the present invention are apparent from the detailed description and figures set forth below.

BRIEF DESCRIPTION OF THE DRAWINGS

The foregoing and other advantages of the invention will become apparent upon reading the following detailed description and upon reference to the drawings.

Figure 1A:
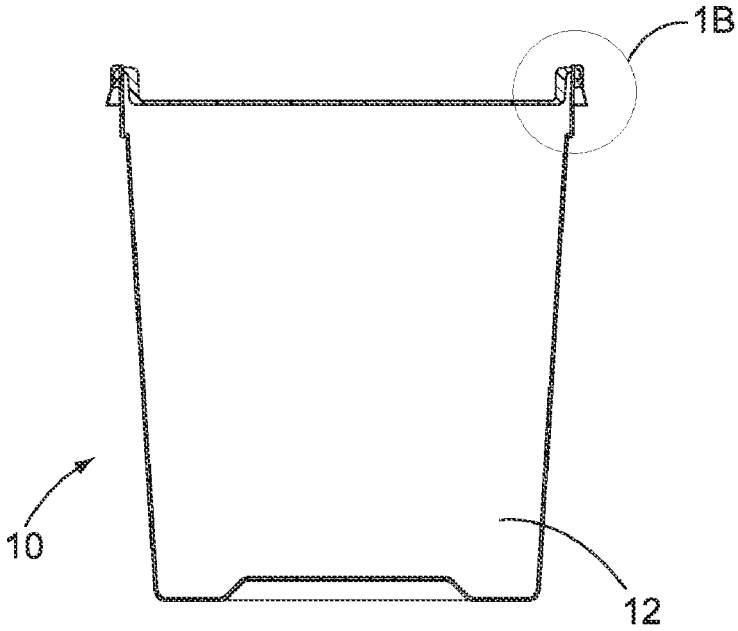
FIG. 1*a* is a cross-sectional view of a container assembly according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Figure 2:
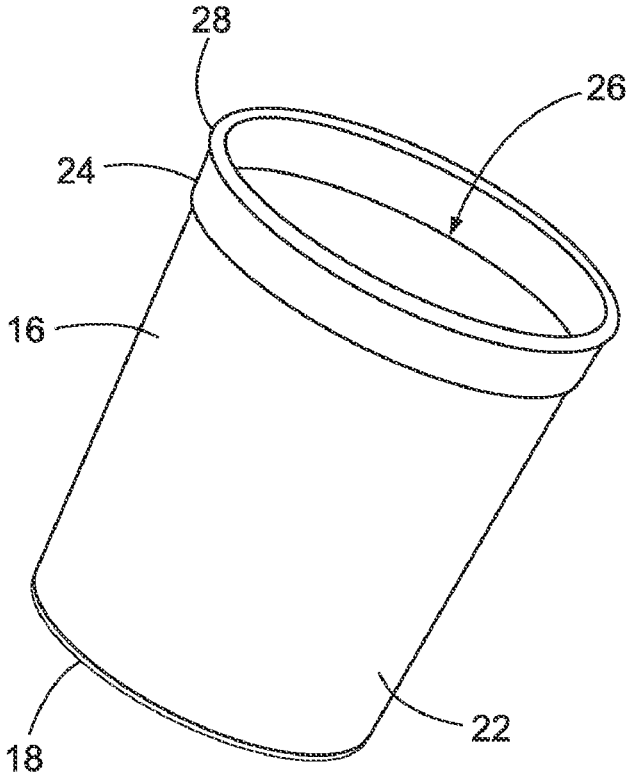
FIG. 2 is a perspective top view of the container of FIGS. 1*a*, 1*b*.
Figure 3B:
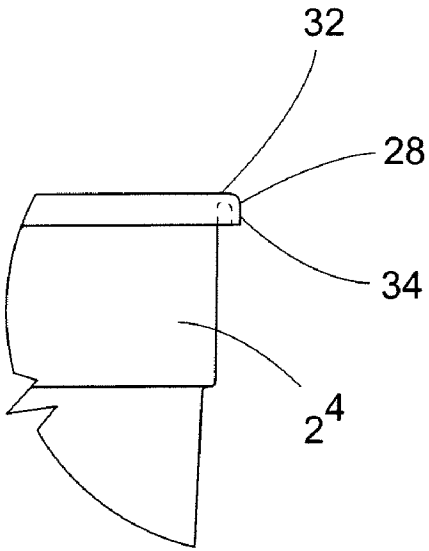
FIG. 3*b* is an enlarged side view of Area 3*b* of FIG. 3*a*.
Figure 3A:
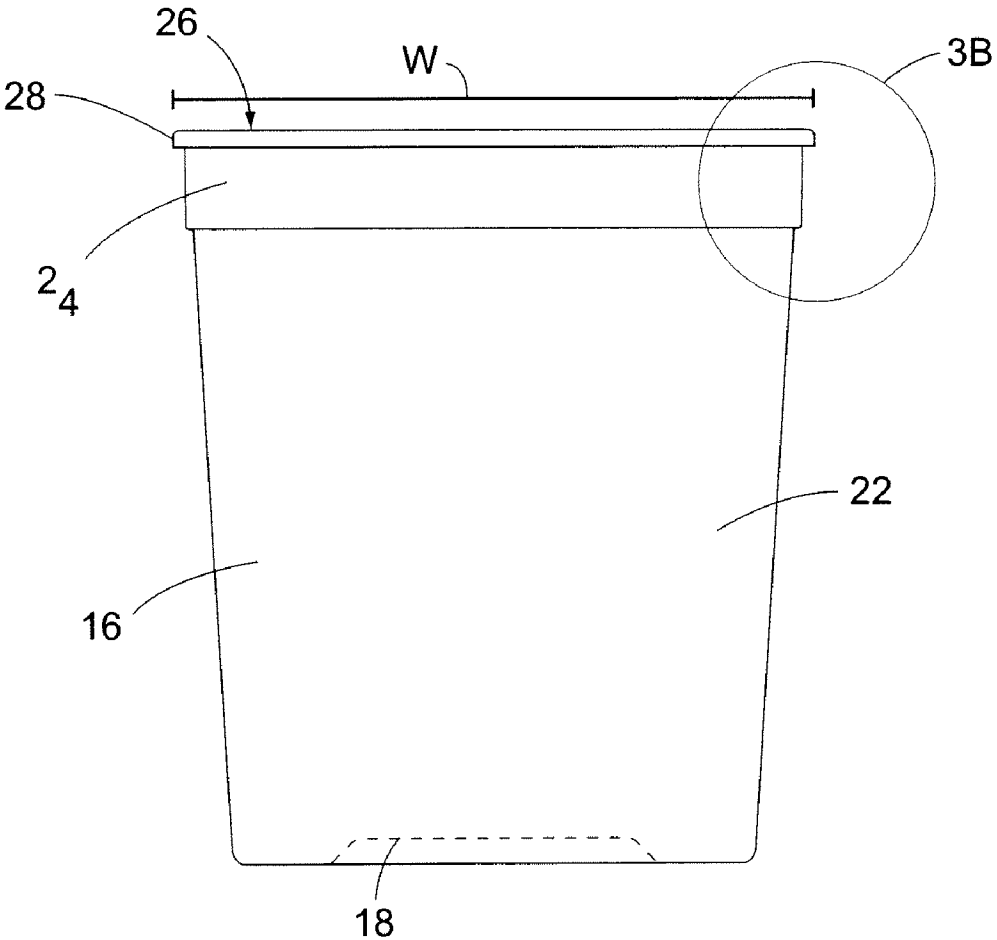
FIG. 3*a* is a side view of the container of FIGS. 1*a*, 1*b*.

FIG. 1*a* illustrates a container assembly 10 according to one embodiment. The container assembly 10 includes a container 12 and a lid 14. The container 12, shown in more detail in FIGS. 2, 3*a*, 3*b*, may be formed from a suitable polymer, such as polyurethane, polypropylene, polyethylene, polyethylene terephthalate, polyester, polyvinyl chloride, another type of thermoplastic polymer, or a suitable combination of polymers. The container 12 includes a body 16 having a bottom wall 18 and at least one sidewall 22. Although the container 12 of the illustrated embodiments is generally cylindrical in shape, it is contemplated that the container may have other suitable shapes including, for example, oval, square, rectangular, other polygonal or non-polygonal shapes. The container 12 may be sized to hold any suitable amount of contents (e.g., food, liquids, or other items).

The container 12 may include one or more reinforcing elements molded into the sidewall 22 and/or the bottom 18 that reinforce or strengthen the container 12. In the illustrated embodiments, the container 12 includes a generally horizontal band 24 (see FIGS. 2, 3*a*, 3*b*) near an open top 26 of the container 12. This band 24 strengthens the upper portion of the container 12 near the open top 26, thereby assisting in preventing or inhibiting the container 12 from deforming and/or collapsing. Thus, the band 24 assists in preventing contents from the container 12 from spilling out. The band 24 (or other reinforcing portions) may also include grooves or the like for adding comfort and/or decreasing the likelihood of the container 12 slipping from a user's grip. It is contemplated that the bottom 18 of the container 12 may also include one or more reinforcing elements.

The container 12 further includes a lip portion 28 positioned near or at the open top 26 of the container 12. The lip portion 28 extends from the sidewall 22 and includes a lip top 32 (see FIG. 3*b*) extending generally outward from the sidewall 22 and being generally parallel to the bottom 18. The lip portion 28 also includes a lip side 34 extending generally downward from the lip top 32 and being generally parallel to (or concentric with) the sidewall 22. The lip portion 28 further assists in adding strength to the container 12. Furthermore, as will be described in more detail below, the lip portion 28 assists in forming a seal with the lid 14 such that contents of the container 12 are inhibited from spilling out from the container 12.

Figure 4:
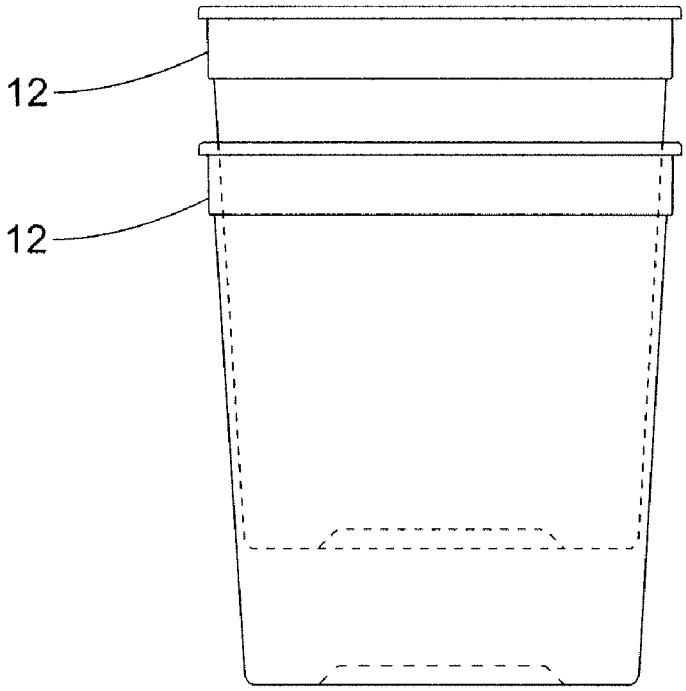
FIG. 4 is a side view of the container of FIGS. 1-3 being stacked with a like container.

The width W of the container 12 (FIG. 3*a*) is generally tapered such that the open top 26 has the greatest width, and the bottom 18 has the smallest width. This tapering feature assists in allowing two or more like containers 12, 12' (see FIG. 4) to be stacked.

Figure 1B:
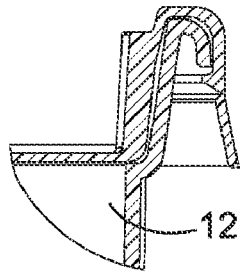
FIG. 1*b* is an enlarged cross-sectional view of area 1*b* of FIG. 1*a*.
Figure 5:
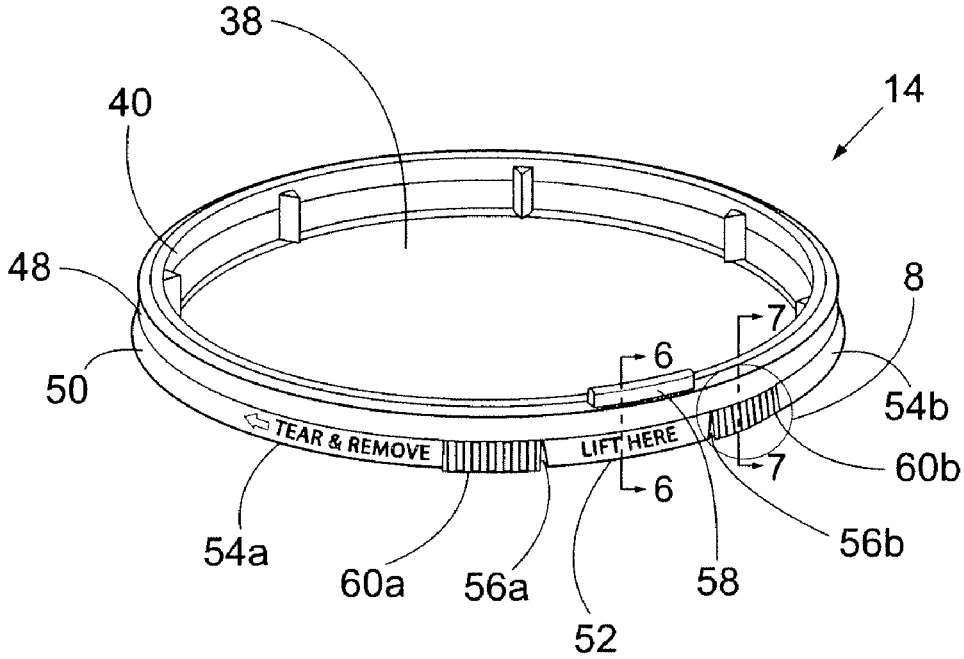
FIG. 5 is a perspective top view of a lid according to one embodiment of the present invention.
Figure 7:
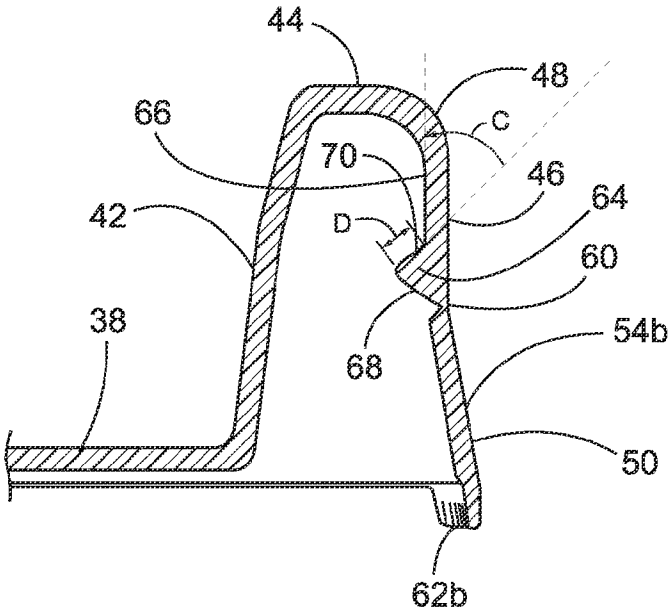
FIG. 7 is a cross-sectional view of the lid of FIG. 5 taken generally through line 7-7.
Figure 6:
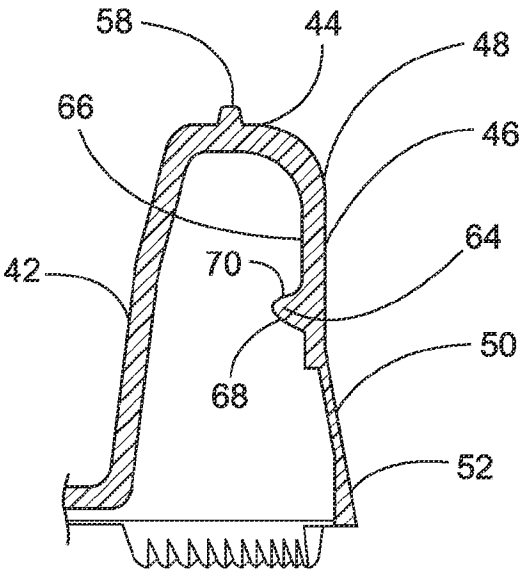
FIG. 6 is a cross-sectional view of the lid of FIG. 5 taken generally through line 6-6.

Turning now to FIGS. 5-7, the lid 14 of FIGS. 1*a*, 1*b* is shown in greater detail. The lid 14 may be injection-molded from a similar polymer as the container 12 or any other suitable polymer or combination of polymers. As will be described in more detail, one suitable polymer from which the lid 14 may be formed includes linear low density polyethylene (LLDPE) resin. The lid 14 comprises a generally flat interior disc portion 38 and an outer ridge portion 40 extending therefrom. The outer ridge portion 40 includes a first ridge side 42 (see FIGS. 6-7) extending generally upwardly from the disc portion 38 and being generally perpendicular to the disc portion 38. The outer ridge portion 40 further includes a ridge top 44 integral with and extending outward from the first ridge side 42 and being generally parallel to the disc portion 38. The outer ridge portion 40 further includes a second ridge side 46 integral with and extending generally downwardly from the ridge top 44 and being generally parallel to (or concentric with) the first ridge side 42. A cross-sectional view of the lid 14 through line 6-6 of FIG. 5 is shown in FIG. 6. A cross-sectional view of the lid 14 through line 7-7 of FIG. 5 is shown in FIG. 7.

The second ridge side 46 of the lid 14 is generally divided into a top section 48 and a bottom section 50. The top section 48 has a greater thickness than the bottom section 50. The bottom section 50 includes at least one fixed tab 52 and at least one tear band 54. Two fixed tabs 52 and two tear bands 54 are included in the illustrated embodiment. In the illustrated embodiment, the bottom section 50 of the lid 14 includes two fixed tabs 52 (the second fixed tab is not shown) positioned generally opposite one another along the perimeter of the second ridge side 46 and separated from one another by two tear bands 54*a*, 54*b*. It is contemplated that other amounts of fixed tabs and/or tear bands may also be used. It may be desirable, however, for more than one fixed tab and tear band to be used so that the tear band is less likely to flex and stretch to allow a user to remove the lid 14 without providing tamper evidence (e.g., breaking a vertical membrane, as described below).

Figure 8:
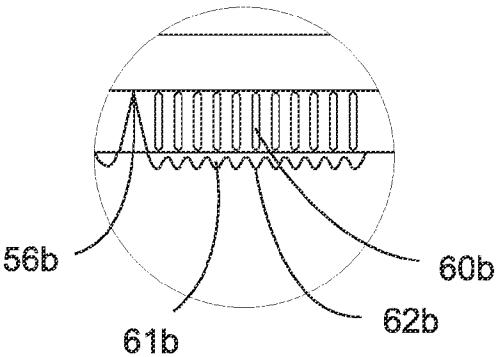
FIG. 8 is an enlarged cross-sectional view of area 8 of FIG. 5.

The fixed tabs 52 are attached to and separated from the tear bands 54*a*, 54*b* by a thin, vertical membrane 56*a*, 56*b* (see FIG. 8). The vertical membranes 56*a*, 56*b* have a smaller thickness than the bottom section 50. As described in more detail below, breakage of the vertical membrane(s) 56*a*, 56*b* provides tamper-evidence by indicating to a user or consumer that someone previously opened or attempted to open the container assembly 10 and that the contents of the container 12 may be contaminated.

According to one embodiment, to remove the lid 14 from the container 12, a user generally grasps a section of the outer ridge portion 40 of the lid 14 that includes the fixed tab 52 and pushes up on the fixed tab 52 to break the vertical membrane (s) 56*a*, 56*b*. For example, a user may place his or her index finger at or near the ridge top 44 to grip the lid 14 and use his or her thumb to pry open the lid 14 by pushing up on the fixed tab 52. To assist in gripping the lid 14, the ridge top 44 may include a raised gripping feature 58 (see FIG. 6). Because the thickness of the fixed tabs 52 and the tear bands 54*a*, 54*b* are generally smaller than the thickness of the top section 48 of the second ridge side 46, the fixed tab 52 and/or the tear bands 54*a*, 54*b* are generally weak and flexible. This assists in preventing or inhibiting the fixed tabs 52 and/or the tear bands 54*a*, 54*b* from being used as points of rigid leverage without breaking the vertical membrane 56*a*, 56*b*.

In the illustrated embodiment, the tear bands 54*a*, 54*b* include pull tabs 60*a*, 60*b* positioned near or adjacent to the respective vertical membranes 56*a*, 56*b*. The pull tabs 60*a*, 60*b* are shown in more detail in FIG. 8, which is a close-up view of Area 3*b* of FIG. 5. The pull tabs 60*a*, 60*b* generally extend from a free side 63 of the second ridge side 46 and include ribbed surfaces 65 and tabs 61*a*, 61*b* including respective ridged edges 62*a*, 62*b*. The ribbed surfaces 65 and ridged edges 62*a*, 62*b* assist in providing a tactile cue to a user for where to position and grip the tear band 54*a*, 54*b* for removal. The ribbed surfaces 65 and ridged edges 62*a*, 62*b* also assist in preventing or inhibiting the user's fingers from slipping when the pull tabs 60*a*, 60*b* are gripped and/or pulled by the user.

The tear bands 54*a*, 54*b* are attached to the top section 48 of the second ridge side 46 by a thinned-out area 60. The thickness of the thinned-out area is smaller than the thickness of the tear bands 54*a*, 54*b*. After the user lifts the fixed tab 52, thereby breaking at least one of the vertical membranes 56*a*, 56*b*, the user may grip the vertical pull tab 60*a*, 60*b* adjacent to the broken vertical membrane 56*a*, 56*b* and pull the tear band 54*a*, 54*b* such that the tear band 54*a*, 54*b* is removed from the second ridge side 46 along the thinned-out area 60. This process is then repeated to remove the remaining tear band 54*a*, 54*b*.

As mentioned above, in one embodiment of the present invention, the lid 14 or a portion thereof includes linear low density polyethylene (LLDPE) resin. LLDPE may be desirable because it is generally flexible in nature, thereby promoting tearing of the vertical membranes 56*a*, 56*b* when the fixed tabs 52 are lifted. The flexible nature of LLDPE inhibits a consumer from being able to pull off the lid 14 without tearing or breaking the vertical membranes 56*a*, 56*b*. LLDPE is stiff enough, however, to form seal with a container.

According to one embodiment, the lid 14 includes a sealing feature to assist in reducing or eliminating leakage of the container 12. Referring back to FIG. 1*b*, which shows a magnified, cross-sectional view of Area 1*b* of the container assembly 10 of FIG. 1*a*, and FIGS. 6 and 7, a protrusion 64 is formed on an inner surface 66 of the second ridge side 46 of the lid 14. An Angle C formed between the inner surface 66 of the second ridge side 46 of the lid 14 and a top portion 70 of the protrusion 64 generally ranges from about 70° up to about 90°. In one embodiment, the Angle C is approximately 75°. The length D of the top portion 70 of the protrusion 64 generally ranges from about 0.025 in. to about 0.032 in. In one embodiment, the length D of the top portion 70 is about 0.025 in. This relatively large Angle C and relatively long length D of the top portion 70 of the protrusion 64 provide an aggressive undercut, which assists in sealing the lid 14 tightly to the container 12. These characteristics also increase resistance, making it difficult for a user to remove the lid 14 from the container 12 without tearing the vertical membrane(s) 56*a*, 56*b* and/or removing the tear bands 54*a*, 54*b*. Thus, the container assembly 10 is more likely to show evidence of tampering (e.g., the broken vertical membrane(s) 56*a*, 56*b* and/or the removed tear bands 54*a*, 54*b*).

When the container assembly 10 is in a closed position (as in FIGS. 1*a*, 1*b*), the protrusion 64 is generally positioned below and abuts the bottom of the lip side 34 of the container 10 so that a first barrier or seal may be formed. A second seal is formed by the ridge top 44 of the lid 14 contacting the lip top 32 of the container 10. In some embodiments, a third seal is formed between an inner surface 72 of the first ridge side 42 of the lid 14 and a step located along the perimeter or circumference of an interior surface of the container 10 near the open top 26. Examples of such a "triple seal" feature are generally described in U.S. Pat. Nos. 6,056,138 and 6,196,404, both of which have been assigned to Newspring Industrial Corp. (East Newark, N.J.), and both of which are incorporated by reference in their entireties. The combination of seals assists in making the container assembly 10 leak-resistant or leak-proof. Furthermore, the combination of seals makes it more difficult for a user to remove the lid 14 without breaking the vertical membrane 56*a*, 56*b* and/or removing the tear bands 54*a*, 54*b*. Thus, evidence of tampering is more likely to exist, thereby alerting the user that the contents of the container may have been tampered with.

As shown in FIGS. 6 and 7, the protrusion 64 is separate from the tear bands 54*a*, 54*b*. Thus, when the tear bands 54*a*, 54*b* are removed, the lid 14 may still form a seal with the container 10 via the protrusion 64. This is desirable because it allows for the lid 14 to be resealed to the container 10 after the lid 14 has been initially removed. Furthermore, the tear bands 54*a*, 54*b* do not interfere with placing and sealing the lid 14 on the container 10. For the reasons provided above, the tear bands 54*a*, 54*b* do, however, need to be removed in order to easily remove the lid 14 from the container 10.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A lid comprising:

a generally flat interior portion; and an outer ridge area surrounding the interior portion, the outer ridge area including a first ridge side, a ridge top, and a second ridge side, the first ridge side extending generally upward from the interior portion, the ridge top extending from the first ridge side and being generally parallel to the interior portion, the second ridge side extending generally downward from the ridge top, the second ridge side including a top section and a bottom section, an inner surface of the top section including a protrusion, the bottom section located below the protrusion, a thickness of the bottom section being smaller than a thickness of the top section above the protrusion, the bottom section including two fixed tabs and two tear bands, the fixed tabs being separated from the tear bands by at least one vertical membrane.

2. The lid of claim 1 , wherein the protrusion is configured to form a seal with a container.

3. The lid of claim 1 , wherein the lid includes linear low density polyethylene.

4. The lid of claim 1 , wherein a portion of at least one tear band positioned adjacent to the vertical membrane includes a tab having a ridged edge.

5. The lid of claim 1 , wherein at least one tear band is separated from the top section of the second ridge side by an area having a thickness smaller than the thickness of the bottom section.

6. The lid of claim 1, wherein each of the two fixed tabs is positioned generally opposite one another and each of the two tear bands is positioned generally opposite one another.

7. The lid of claim 1 , further comprising a raised gripping feature positioned on the ridge top generally above at least one fixed tab.

8. The lid of claim 1 , wherein the lid is generally circular.

9. A tamper-evident lid comprising:

a generally flat disc portion; and an outer ridge area surrounding the disc portion, the outer ridge area including a first ridge side extending generally upward from the disc portion, a ridge top extending from the first ridge side and being generally parallel to the disc portion, and a second ridge side extending generally downward from the ridge top, the second ridge side including a top section and a bottom section, a thickness of the bottom section being smaller than a thickness of the top section, the top section being separated from the bottom section by a thinned-out area, the top section including at least one protrusion above the thinned-out area, the bottom section including at least one fixed tab and at least one tear band, the at least one fixed tab being separated from the at least one tear band by at least one vertical membrane, a thickness of the vertical membrane being smaller than the thickness of the bottom section, wherein the lid is configured to be resealable to a container.

10. The lid of claim 9, wherein a portion of the at least one tear band positioned adjacent to the vertical membrane includes a tab having a ridged edge.

11. The lid of claim 9, wherein the at least one fixed tab is two fixed tabs and the at least one tear band is two tear bands.

12. The lid of claim 11, wherein each of the two fixed tabs are positioned generally opposite one another and each of the two tear bands are positioned generally opposite one another.

13. The lid of claim 9, further comprising a raised gripping feature positioned on the ridge top generally above the at least one fixed tab.

14. The lid of claim 9, wherein the lid is formed from linear low density polyethylene.

15. The lid of claim 9, wherein the lid is generally circular.

16. The lid of claim 9, further comprising a raised gripping feature positioned on the ridge top generally above the at least one fixed tab.

17. The lid of claim 9, wherein the at least one protrusion is configured to form a seal with the container.

* * * * *